United States Patent [19]

Dahlgren et al.

[11] 3,954,573

[45] May 4, 1976

[54] COMPOSITIONS AND PROCESS FOR THE ELECTROPLATING OF METAL OR METAL ALLOY COATINGS OF HIGH BRIGHTNESS ON A BASE SURFACE

[75] Inventors: Karl Gustav Lennart Dahlgren, Odsmal; Frans Adam Kolosh, Stenungsund, both of Sweden

[73] Assignee: Berol Kemi AB, Stenungsund, Sweden

[22] Filed: Oct. 17, 1974

[21] Appl. No.: 515,737

[30] Foreign Application Priority Data

Oct. 18, 1973 Sweden ..... 7314211

[52] U.S. Cl. ..... 204/43 S; 204/54 R

[51] Int. Cl.[2] ..... C25D 3/32; C25D 3/56; C25D 3/60

[58] Field of Search ..... 204/43 S, 54 R, 54 L, 204/53, 114, 123

[56] References Cited

UNITED STATES PATENTS

| | | | |
|---|---|---|---|
| 2,460,252 | 1/1949 | DuRose et al. | 204/43 S |
| 3,749,649 | 7/1973 | Valayil | 204/43 S |
| 3,850,765 | 11/1974 | Karustis et al. | 204/43 S |

*Primary Examiner*—G. L. Kaplan

[57] ABSTRACT

The present invention provides compositions and a process for the electroplating of metal or metal alloy coatings of high brightness on a base surface, and especially coatings of tin or tin-lead alloys having a high brightness. The compositions comprise a 2,4,6 — substituted phenol, at least one substituent of which includes at least one secondary, tertiary or quaternary nitrogen atom or an alkylene oxide adduct of such phenol and, optionally, an aldehyde and/or a surface — active compound.

23 Claims, No Drawings

COMPOSITIONS AND PROCESS FOR THE ELECTROPLATING OF METAL OR METAL ALLOY COATINGS OF HIGH BRIGHTNESS ON A BASE SURFACE

The methods now commonly used for the electroplating of tin and tin-lead alloys result in dull or semi-dull, porous or semi-crystalline coatings having poor corrosion resistance. However, French Pat. Nos. 70.26464 and 71.19911 disclose an electroplating process utilizing an electrolyte bath containing as major constituents (a) a phenol derivative, (b) an aldehyde, and (c) an emulsifier comprising an alkylene oxide, adduct, and resulting in bright surface coatings resistant to corrosion. The process has, however, the disadvantage that, in order to obtain coatings of high brightness, one has to maintain a relatively low metal ion concentration and a low current density in the bath, leading to a slow deposition rate, and a low production rate. A high deposition rate is of special importance in continuous processes. Owing to the foaming tendency of the bath, it is difficult to facilitate metal ion transport and obtain a faster reaction by means of stirring of the electrolyte bath, or blowing-through with a gas, or movement of the cathode.

In accordance with the instant invention, these difficulties are avoided by providing an electroplating composition comprising a metal or metal alloy compound, such as a tin or tin-lead alloy plating compound, a 2, 4, 6-substituted phenol, of which at least one substituent includes at least one secondary, tertiary or quaternary nitrogen atom, or an alkylene oxide adduct of such phenol, and optionally, an aldehyde and/or a surface-active compound. Such phenols are effective brightening agents, and the electroplating compositions of the invention give coatings of high brightness, high corrosion resistance and good soldering capacity. These electroplating compositions in aqueous solution or dispersion, as in an electroplating bath, are stable against oxidative decomposition, and are non-foaming, and further allow the use of high current densities and high metal ion concentrations. Owing to this, the production capacity can be quite high without the risk of deterioration of quality of the coatings.

The reason why the phenols of the invention have such advantageous properties is not known, but it is assumed to be connected to a hydrophiliclipophilic balance quite suitable to the electroplating bath. The phenol may form complexes with the metal ions, resulting in a decrease of the metal ion concentration in the boundary layer at the cathode, thus favoring the formation of a microcrystalline coating. Owing to the fact that the phenols also possess surface-active properties, they are absorbed together with any surface-active component present on the peaks of the base surface, so that the deposition is comparatively inhibited on the peaks of the base surface, and is accelerated in the valleys, which has a levelling effect. If the electroplating bath does not include the phenol, a coarse-grained dull coating is obtained.

The phenols of the invention have at least one substituent containing at least one secondary, tertiary or quaternary nitrogen atom. Representative nitrogen substituents have the general formula:

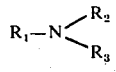

wherein:

$R_1$ represents a straight or branched, saturated or unsaturated, aliphatic, cycloaliphatic or aromatic hydrocarbon group having from one to about twenty carbon atoms.

$R_2$ represents a straight or branched, saturated or unsaturated, aliphatic, cycloaliphatic or aromatic hydrocarbon group having from one to about twenty carbon atoms, and optionally substituted with hydroxy groups, and in which the carbon skeleton in one or several places may be interrupted by hetero atoms comprising nitrogen or oxygen.

$R_3$ represents hydrogen or $R_2$.

$R_2$ and $R_3$ together with the nitrogen atom to which they are bonded can also be linked in a heterocyclic group having from five to seven ring members comprising nitrogen and carbon atoms, at least one of the nitrogen atoms being a secondary or tertiary nitrogen atom, and any substituents having the same structure as defined in $R_2$, or a quaternized group thereof.

Specific examples of preferred nitrogen-containing groups are:

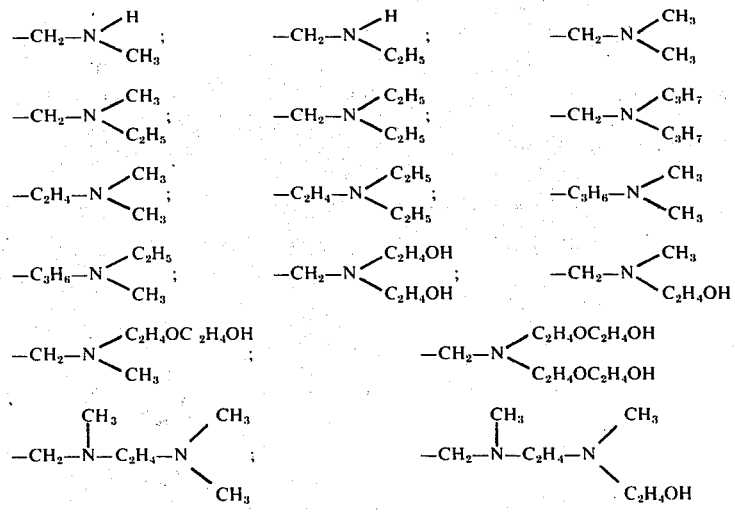

-continued

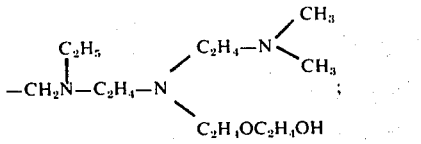

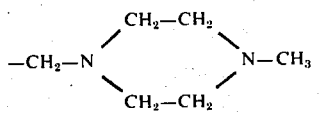

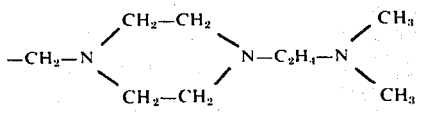

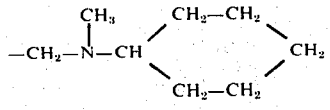

or quaternized derivatives thereof.

As quaternizing agents there can be used compounds having the formulae:

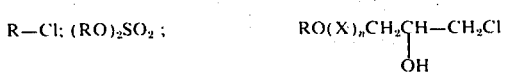

wherein:

R is a straight or branched, saturated or unsaturated, aromatic or aliphatic hydrocarbon group having from one to about ten carbon atoms;

X represents groups derived from alkylene oxide, such as

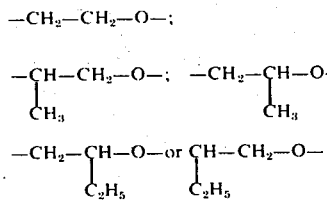

and

*n* is a number from 0 to 6, inclusive.

Especially preferred quaternizing agents are dimethyl sulphate, diethyl sulphate, methyl chloride and ethyl chloride.

Thus, the quaternary nitrogen will contain, as a fourth substituent, a group having the formula:

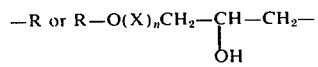

wherein R, X and *n* have the meanings defined above. Normally, the anion is chloride or alkyl sulphate, but the anion can be replaced, if desired, using an anion exchanger, by other anions, such as hydroxyl, bromide, acetate, sulphate, carbonate, citrate or tartrate.

In addition to nitrogen-containing substituents, the phenols may also contain substituents, such as hydrocarbon groups having from one to about ten carbon atoms; alkoxy groups having from one to about ten carbon atoms in the alkyl moiety; hydroxyalkyl groups having from one to about ten carbon atoms; alkoxylated hydroxyalkyl groups; halogen atoms; and primary amino groups, Specific examples of suitable substituents are

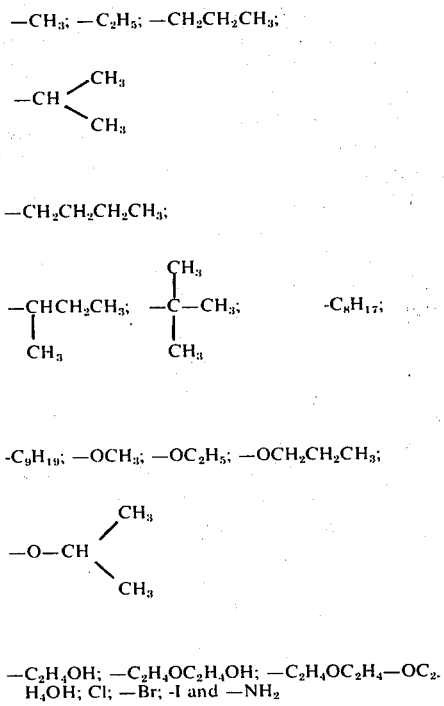

Further, the phenolic hydroxy group may be substituted with one or more, preferably from one to about five, units derived from alkylene oxide. Those alkylene oxides having from two to four carbon atoms are preferred, especially ethylene oxide and propylene oxide.

Any 2, 4, 6-tri substituted phenol can be used. Illustrative examples of phenols which have been tested and found to possess good properties are the following:

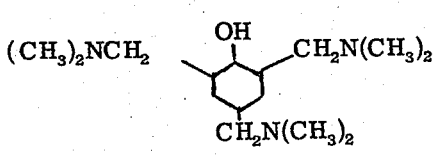

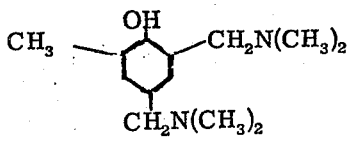

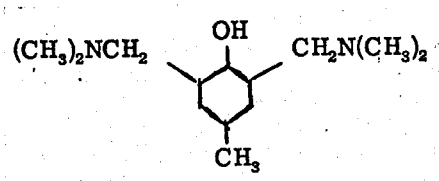

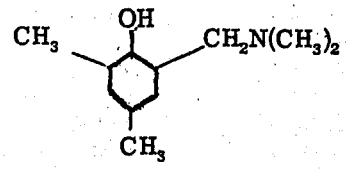

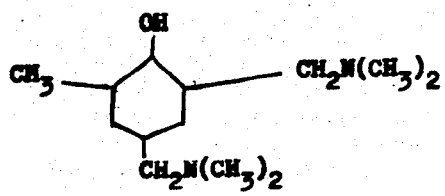

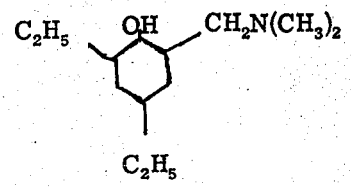

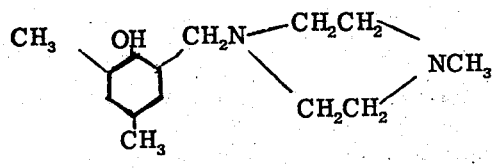

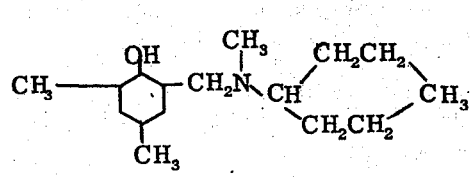

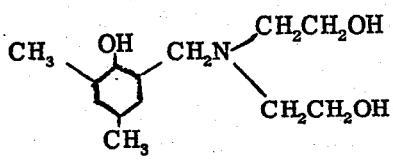

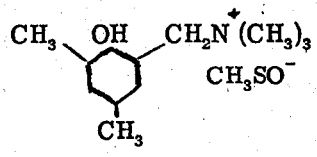

In addition to the phenols, the electroplating composition or bath also should contain an aldehyde and a surface active compound, preferably an alkylene oxide adduct showing emulsifying activity.

Suitable aldehydes are aliphatic aldehydes, such as formaldehyde, acetaldehyde, propionaldehyde, N-butyraldehyde, isobutyraldehyde, N-valeraldehyde, isovaleraldehyde, N-caproaldehyde, glyoxal, crotonaldehyde, and aromatic aldehydes, such as benzaldehyde and cinnamaldehyde. There is no lower limit on the amount of aldehyde, since it can be limited. The amount of aldehyde usually is below 100 grams/1,000 grams of bath.

The surface-active component is a surface-active alkylene oxide adduct. These can be of nonionic, cationic, or ampholytic nature. Examples of suitable surface active alkylene oxide adducts are the monoethers polyoxyalkylene glycols having the formula $$RO(C_2H_4O)_{n1}(C_3H_6O)_{n2}(C_2H_4O)_{n3}H$$

wherein:

R represents a straight or branched, saturated or unsaturated primary or secondary aliphatic or alicyclic group having from eight to twenty carbon atoms, or a mono-, di- or trialkyl-substituted phenol having from six to twenty four carbon atoms in the alkyl moiety, $n_1$, $n_2$, and $n_3$ are each numbers from zero to about fifty, selected in such a way that the sum $n_1+n_2+n_3$ is in from about three to about fifty, and the number of ethylene oxide units is from about 10 to 100% of the total number of alkylene oxide units.

Examples of organic compounds for use in the preparation of such alkylene oxide adducts are the primary alcohols, such as octanol, decanol, lauryl alcohol, stearyl alcohol, oleyl alcohol, eicosanol, docosanol; straight or branched, primary or secondary oxo alcohols prepared according to the Oxo process and having from about eight to twenty carbon atoms, mono, -di-and trialkyl phenols, such as octyl phenol, isooctyl phenol, nonyl phenol, dodecyl phenol, octadecyl phenol, dihexyl phenol, dioctyl phenol, dinonyl phenol, methyl octyl phenol, ethyl nonyl phenol, tributyl phenol, 3-methyl-4, 6-dibutyl phenol, mono-and dibutyl cresol, and nonyl cresol.

Other suitable nonionic surface active compounds are those having the general formula $$H(OC_2H_4)_{m1}-(OC_3H_6)_{m2}-OC_{2\text{-}3}H_{4\text{-}6}-(C_3H_6O)_{m3}-(C_2H_4O)_{m4}-H$$

wherein $m_1$, $m_2$, $m_3$3, and $m_4$ are each numbers from 0 to 100, selected in such a way that $m_1+m_2+m_3+m_4$ is a number from 15 to 150 and $m_1+m_4$ is from 3 to 120.

Examples of surface active compounds of said formula are block copolymers of ethylene oxide and propylene oxide based on propylene glycol to which have been added first propylene oxide to a molecular weight of from 1,000 to about 3,000, and then ethylene oxide to the extent that the amount thereof is from 5 to 80% of the molecular weight of the compound.

Another suitable class of surface active compounds comprises alkylene oxide adducts of amines. These can be represented by the general formula:

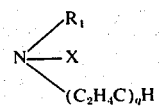

$R_1$ is an optionally hydroxy containing straight or branched saturated or unsaturated aliphatic or cycloaliphatic group having from about six to about twenty-four carbon atoms, the carbon chain optionally being interrupted by one or more hetero atoms of nitrogen and/or oxygen or an optionally hydroxy containing mono- or poly-substituted arylalkyl group having from about eight to about twenty-four carbon atoms; the carbon chain optionally can comprise one or more hydroxyl groups, and can be interrupted by one more hetero atoms of nitrogen and/or oxygen;

q is an integer from 2 to 40; and

X represents an $R_1$ group or $(C_2H_4O)_qH$, wherein $R_1$ and q have the meanings as defined above. If desired, up to about 50% of the units derived from ethylene oxide can be replaced by other units derived from alkylene oxide, such as

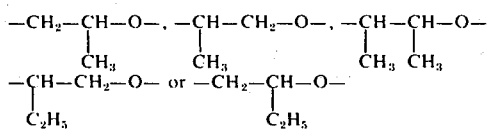

These amines can also be quaternized in a conventional manner, for instance with dimethyl sulphate or methyl chloride.

The alkoxylated nitrogen-containing surface active compounds can be obtained by alkoxylating fatty amines having the formula

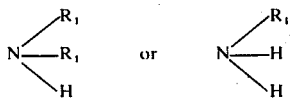

wherein $R_1$ has the meaning as defined above.

Examples of suitable amines are octyl amine, dioctyl amine, dodecyl amine, cetyl amine, stearyl amine, oleyl amine, aminomethylmethyl octyl phenol, bis (aminomethyl) octyl phenol, amino-methylmethyl nonyl phenol, bis (aminomethyl) nonyl phenol and bis (dihydroxyethylaminomethyl) nonyl phenol.

acid is added, preferably about 25 grams/1000 g of bath, to inhibit the decomposition of fluoborate, and the consequent precipitation of lead fluoride. The boric acid has little effect on the character of the deposit produced. The phenols are usually not soluble in water, but because of the amine character of the phenols they are normally soluble in the acidic bath. In case the products are not very soluble in the bath they can be dispersed by the aid of the surface-active compound.

The base surface on which the coating is plated is usually iron, copper or brass. Plating on aluminum is not usually advisable, since some of the aluminum can be dissolved by the acidic bath, unless the aluminum is pretreated to prevent this. The base surface can also be a plastic material which has been made electrically conducting by a coating of, for example, copper.

The process is especially suitable for electroplating tin/lead alloys, but plating pure tin also gives good results.

In acidic tin/lead alloy plating, the tin/lead alloy is usually employed in the form of the fluoborates. Also useful are the fluosilicates, but the fluoborates are usually preferred, since they give a higher quality (finer grained) deposit, are more stable, and give a more satisfactory plated coating directly on steel, although they are more expensive than the fluosilicates.

Further basic information on electroplating can be found in *Modern Electroplating*, Third Edition, by Frederick A. Lowenheim, John Wiley and Sons, Inc. 1974, which disclosure is hereby incorporated by reference.

A typical electroplating bath according to the invention may have the following approximate composition, per 1,000 grams of bath:

| Ingredient | Amount |
|---|---|
| $Sn^{++}$ (in the form of stannous fluoborate) | 10–20 grams |
| $Pb^{++}$ (in the form of plumbous fluoborate) | 5–20 grams |
| Hydrogenfluoborate $HBF_4$ | 20–80 grams<br>preferably 35–45 grams |
| Boric Acid $H_3BO_3$ | 5–30 grams,<br>preferably 20–30 grams |
| One or more 2,4,6-tri-substituted phenols of the invention | 0.5–50 grams<br>preferably 1–30 grams |
| Formaldehyde | 5–30 grams<br>preferably 10–20 grams |
| Surface active alkylene oxide adduct | 0.2–50 grams |

The concentration of metals can vary within broad limits, but usually is within the range from about 5 to about 50 g per 1000 grams of bath. The concentration of fluoboric acid can vary between 20 and 80 grams per 1000 grams of bath, the preferred concentration being about 40 grams per 1000 grams of bath, giving a pH of about 0.5.

The following Examples represent preferred embodiments of the invention:

EXAMPLES 1 TO 9

In a so-called Hull cell a series of electroplatings of iron plate was conducted using an electroplating bath of the following composition:

| Ingredient | Amount per 1,000 grams of bath |
|---|---|
| $Sn^{++}$ in the form of stannous fluoborate | 10 grams |
| $Pb^{++}$ in the form of plumbous fluoborate | 15 grams |
| $HBF_4$ | 40 grams |
| $H_3BO_3$ | 25 grams |
| 2,4,6-substituted phenol of the invention as noted below | 8–32 grams |
| formaldehyde | 12 grams |
| surface active ethylene oxide adduct | 0.8–45 grams |
| water to 1,000 grams of bath | |

The fluoboric acid increases the conductivity of the bath, and gives finer grained deposits, probably because of a decrease in lead ion concentration. Boric

| Structure | Phenol |
|---|---|
| 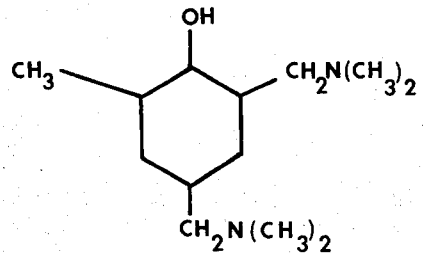 | A |
| 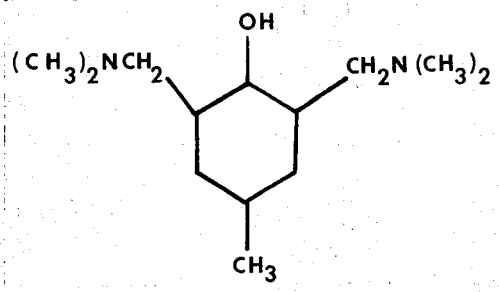 | B |
| 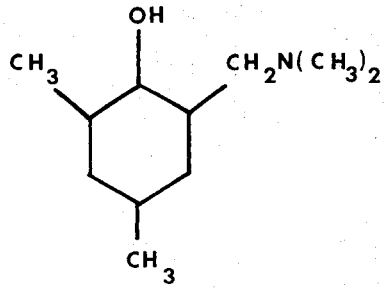 | C |
| 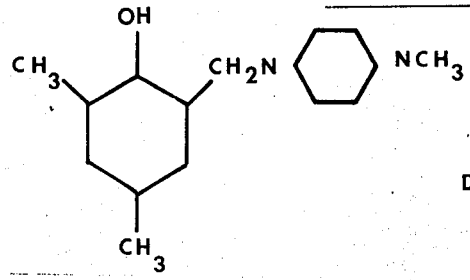 | D |
| 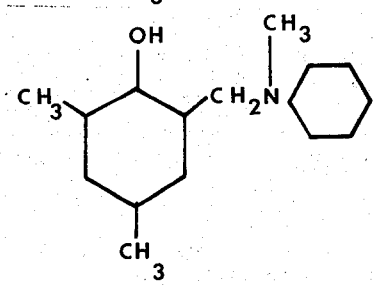 | E |

| Structure | Phenol |
|---|---|
| 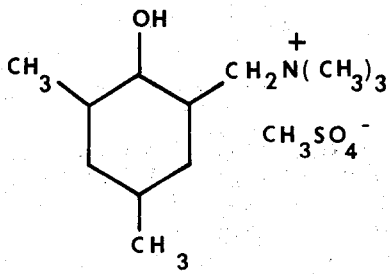 | F |

The surface active alkylene oxide adduct was either an oleyl amine ethoxylated with 8 moles of ethylene oxide per mole of oleyl amine (surfactant I) or a bis-(aminomethyl) nonyl phenol ethoxylated with 9 moles of ethylene oxide (surfactant II).

The anode was an alloy of 60% by weight of tin and 40% by weight of lead. The current strength was 1A, and the electroplating time was 20 minutes. During the plating the bath was agitated continuously with a rod of polyvinyl chloride, moved back and forth at 120 strokes per minute about 1 cm in front of the cathode. The following results were obtained:

TABLE I

| Example No. | Phenol No. | g/1,000 g bath | Surfactant No. | g/1,000 g bath | Current density range giving high brightness (A/ cm²) |
|---|---|---|---|---|---|
| 1 | A | 16 | I | 0.8 | 2.6–2.0 |
| 2 | B | 16 | I | 0.8 | 5.1–1.4 |
| 3 | C | 8 | I | 0.8 | 5.1–0.4 |
| 4 | C | 16 | I | 0.8 | >5.1–0.1 |
| 5 | C | 32 | I | 0.8 | >5.1–0.1 |
| 6 | C | 16 | II | 0.8 | >5.1–<0.1 |
| 7 | D | 16 | I | 0.8 | 5.1–0.1 |
| 8 | E | 16 | II | 45 | 5.1–0.2 |
| 9 | F | 16 | I | 0.8 | 4.0–0.2 |

For comparison purposes, the electroplating was carried out with a bath of the same composition as that stated above but containing 16.0 grams 2, 4, 6-trimethyl phenol/1,000 grams of bath, and 60 grams of surfactant I. As a result high brightness could be obtained at a current density of about 2.0–0.4 A/ cm². This shows that by the addition of phenols according to the invention the current density in many cases can be increased by above 200%, without deleteriously affecting the quality of the coating.

EXAMPLES 10 TO 11

Iron plates were electroplated under the same conditions as in Examples 1 to 9, except that the composition of the electrolyte bath was as stated below:

| Ingredient | Amount per 1,000 grams of bath | |
|---|---|---|
| | Example 10 | Example 11 |
| $Sn^{++}$ (as fluoborate) | 15 | 15 |
| $Pb^{++}$ (as fluoborate) | 15 | 20 |
| $HBF_4$ | 40 | 40 |
| $H_3BO_3$ | 25 | 25 |
| Phenol compound C, Examples 2 to 6 | 16 | 16 |

-continued

| Ingredient | Amount per 1,000 grams of bath | |
|---|---|---|
| | Example 10 | Example 11 |
| Surfactant II | 0.8 | 0.8 |
| $H_2O$ | Balance to 1,000 grams of bath | Balance to 1,000 grams of bath |

Both Examples gave high brightness at a current density of from >5.1 to <0.1 A/cm². From this it is evident that an increase of the tin and lead contents of the electrolyte bath to about 20 grams/1,000 grams of bath does not noticeably diminish high brightness.

EXAMPLES 12 TO 15

In order to test the foaming tendency of an electroplating bath according to the invention, the following foaming tests were conducted.

Electrolyte in an amount of 300 ml was poured into a 2 l graduated cylinder. Nitrogen gas was passed to the bottom of the graduated cylinder by means of a tube and was allowed to bubble through the bath for 15 minutes. The foam height was measured regularly. After 15 minutes the addition of nitrogen gas was stopped, and the foam was allowed to collapse. The foam level decrease was noted regularly. The baths tested had the following composition:

TABLE II

| Example No. | Amount per 1,000 grams of bath | | | | |
|---|---|---|---|---|---|
| | 12 | 13 | 14 | 15 | Control |
| $Sn^{++}$ (as stannous fluoborate) | 10 | 10 | 10 | 10 | 10 |
| $Pb^{++}$ (as plumbous fluoborate) | 15 | 15 | 15 | 15 | 15 |
| Formaldehyde | 15 | 15 | 15 | 15 | 15 |
| Phenol C, Examples 2 to 6 | 16 | 16 | 16 | 16 | — |
| 2,4,6-trimethyl phenol | — | — | — | — | 161 |
| Surfactant I | — | — | 0.8 | 2.0 | 60 |
| Surfactant II | 0.8 | 2.0 | — | — | — |
| $HBF_4$ | 40 | 40 | 40 | 40 | 40 |
| Boric Acid | 25 | 25 | 25 | 25 | 25 |

[1]owing to the poor solubility of the trimethyl phenol the amount of surfactant had to be greatly increased in order to obtain a homogeneous composition.

The following results were obtained:

TABLE III

| | Foam volume in mls Nitrogen gas bubbling | | | | | Foam volume in mls After stoppage | | | | |
|---|---|---|---|---|---|---|---|---|---|---|
| | 2 min. | 5 min. | 10 min. | 15 min. | gas flow stopped | 15 sec. | 1 min. | 5 min. | 10 min. | 15 min. |
| Ex 12 | 30 | 30 | 45 | 45 | | 0 | 0 | 0 | 0 | 0 |
| Ex 13 | 50 | 50 | 60 | 60 | | 0 | 0 | 0 | 0 | 0 |
| Ex 14 | 270 | 560 | 1060 | 1400 | | 1400 | 1280 | 660 | 105 | 45 |
| Ex 15 | 310 | 680 | 1160 | 1540 | | 1500 | 1400 | 780 | 85 | 40 |
| Control | 370 | 930 | 1620 | 1940 | | 1930 | 1920 | 1460 | 980 | 380 |

The foaming tendency of the Control test sample was considerably higher than of any of the Examples according to the invention. An especially low foaming tendency was obtained in Examples 12 and 13, where the phenol of the invention was combined with ethoxylated bis (aminomethyl) nonyl phenol.

Having regard to the foregoing disclosure, the following is claimed as inventive and patentable embodiments thereof: range from about phenol, from about grams of

1. An acidic aqueous electroplating bath that upon plating gives coatings of high brightness, high corrosion resistance, and good soldering capacity, comprising a plating compound selected from the group consisting of tin and tin-lead alloy plating compounds supplying tin and lead ion to the aqueous electroplating bath in an amount within the rage of from 5 to about 50 grams per 1000 grams of bath and a 2, 4, 6-substituted phenol of which at least one substituent includes at least one secondary, tertiary or quaternary nitrogen atom, or an alkylene oxide adduct of such phenol in an amount within the range from 0.5 to about 50 grams per 1000 of bath.

2. An acidic aqueous electroplating bath according to claim 1, comprising as the plating compound a fluoborate selected from the group consisting of stannous fluoborate and plumbous fluoborate.

3. An acidic aqueous electroplating bath according to claim 1, comprising in addition, an aldehyde in an amount up to 100 grams per 1000 grams of bath.

4. An acidic aqueous electroplating bath according to claim 1, comprising, in addition, a surface active compound other than the 2, 4, 6-substituted phenol and selected from the group consisting of nonionic, cationic and ampholytic surface-active compounds in an amount within the range from about 0.2 to about 50 grams per 1000 grams of bath.

5. An acidic aqueous electroplating bath according to claim 1, comprising, in addition, an aldehyde in an amount up to 100 grams per 1000 grams of bath and a surface active compound other than the 2, 4, 6-substituted phenol and selected from the group consisting of nonionic, cationic and ampholytic surface-active compounds in an amount within the range from about 0.2 to about 50 grams per 1000 grams of bath.

6. An acidic aqueous electroplating bath according to claim 1, in which the nitrogen atom is in a radical having the formula:

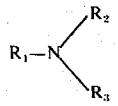

wherein $R_1$ is a hydrocarbon group having from one to about twenty carbon atoms; $R_2$ is selected from the group consisting of hydrocarbon groups having from one to about twenty carbon atoms, such groups substituted with hydroxyl groups, and such groups having in the carbon chain at least one nitrogen or oxygen atom; and $R_3$ represents hydrogen or $R_2$.

7. An acidic aqueous electroplating bath according to claim 6, in which $R_2$ and $R_3$ are taken together with the nitrogen atom in a heterocyclic group having from five to seven ring members comprising nitrogen and carbon atoms, at least one of the nitrogen atoms being a secondary or tertiary nitrogen atom, and any substituent present having the structure of $R_2$.

8. An acidic aqueous electroplating bath according to claim 1, in which the nitrogen atom is in a substituent having the formula:

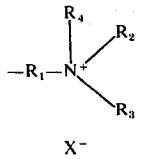

wherein $R_1$ is a hydrocarbon group having from one to about twenty carbon atoms; $R_2$ is selected from the group consisting of hydrocarbon groups having from one to about twenty carbon atoms, such groups substituted with hydroxy groups, and such groups having in the carbon chain at least one nitrogen or oxygen atom; and $R_3$ represents hydrogen or $R_2$; $R_4$ is H or $R_2$; and X is an anion.

9. An electroplating composition according to claim 1, in which the phenol is 2-dimethylaminomethyl-4, 6-dimethyl phenol.

10. An acidic aqueous electroplating bath according to claim 1, comprising in addition a surface-active alkylene oxide adduct other than the 2, 4, 6-substituted phenol in an amount within the range from about 0.2 to about 50 grams per 1000 grams of bath.

11. An acidic aqueous electroplating bath according to claim 10, in which the alkylene oxide adduct has the formula:

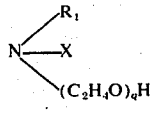

wherein $R_1$ is selected from the group consisting of aliphatic or cycloaliphatic groups having from about six to about twenty four carbon atoms; such groups containing hydroxy groups; and such groups having in the carbon chain at least one nitrogen and/or oxygen atom; or an optionally hydroxy containing arylalkyl groups having from about eight to about twenty four carbon atoms; such groups containing hydroxy groups; and such groups having in the carbon chain at least one nitrogen and/or oxygen atom; $q$ is an integer from 2 to 40; and X represents $R_1$ or $(C_2H_4O)_qH$, wherein $R_1$ and q are as defined above.

12. An acidic aqueous electroplating bath according to claim 1, comprising fluoboric acid in an amount within the range from about 20 to about 80 grams per 1000 grams of bath.

13. An acidic aqueous electroplating bath according to claim 12, in which the bath contains, per 1000 grams, from about 5 to about 30 grams of formaldehyde.

14. A process for electroplating metal or metal alloy coatings having a high brightness, high corrosion resistance, and good soldering capacity on a base surface which comprises electroplating the metal or metal alloy coating from an acidic aqueous electrolyte bath comprising a plating compound selected from the group consisting of tin and tin-lead alloy plating compounds supplying tin and lead ion to the aqueous electroplating bath in an amount within the range of from about 5 to about 50 grams per 1000 grams of bath; and an amount within the range from about 0.5 to about 50 grams per 1000 grams of bath of a 2, 4, 6-substituted phenol of which at least one substituent includes at least one secondary, tertiary or quaternary nitrogen atom, or an alkylene oxide adduct of such phenol.

15. A process according to claim 14, in which the bath comprises as the plating compound a fluoborate selected from the group consisting of stannous fluoborate and plumbous fluoborate.

16. A process according to claim 14, in which the bath comprises, in addition, an aldehyde in an amount up to 100 grams per 1000 grams of bath.

17. A process according to claim 14, in which the bath comprises, in addition, a surface-active compound other than the 2, 4, 6-substituted phenol and selected from the group consisting of nonionic, cationic and ampholytic surface-active compounds in an amount within the range from about 0.2 to about 50 grams per 1000 grams of bath.

18. A process according to claim 14, in which the bath comprises, in addition, per 1000 grams of bath, an aldehyde in an amount up to 100 grams and a surface active compound other than the 2, 4, 6-substituted phenol and selected from the group consisting of nonionic, cationic and ampholytic surface-active compounds in an amount within the range from about 0.2 to about 50 grams.

19. A process according to claim 14, in which the nitrogen atom on the phenol is in a radical having the formula:

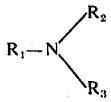

wherein $R_1$ is a hydrocarbon group having from one to about twenty carbon atoms; $R_2$ is selected from the group consisting of hydrocarbon groups having from one to about twenty carbon atoms, such groups substituted with hydroxy groups, and such groups having in the carbon chain at least one nitrogen or oxygen atom; and $R_2$ represents hydrogen or $R_2$.

20. A process according to claim 19, in which $R_2$ and $R_3$ are taken together with the nitrogen atom in a heterocyclic group having from five to seven ring members comprising nitrogen and carbon atoms, at least one of the nitrogen atoms being a secondary or tertiary nitrogen atom, and any substituent present having the structure of $R_2$.

21. A process according to claim 14, in which the nitrogen atom of the phenol is in a substituent having the formula:

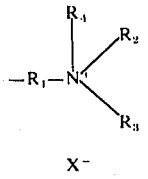

wherein $R_1$ is a hydrocarbon group having from one to about twenty carbon atoms; $R_2$ is selected from the group consisting of hydrocarbon groups having from one to about twenty carbon atoms, such groups substituted with hydroxy groups, and such groups having in the carbon chain at least one nitrogen or oxygen atom; and $R_3$ represent hydrogen or $R_2$; $R_4$ is H or $R_2$; and X is an anion.

22. A process according to claim 14, in which the phenol is 2-dimethylaminomethyl-4, 6-dimethyl phenol.

23. A process according to claim 14, in which the bath comprises in addition a surface active alkylene oxide adduct other than the 2, 4, 6-substituted phenol in an amount within the range from about 0.2 to about 50 grams per 1000 grams of bath.

* * * * *

PO-1050
(5/69)

UNITED STATES PATENT OFFICE

CERTIFICATE OF CORRECTION

Patent No. 3,954,573 Dated May 4, 1976

Inventor(s) Karl Gustav Lennart Dahlgren

It is certified that error appears in the above-identified patent and that said Letters Patent are hereby corrected as shown below:

Column 1, line 15 : Delete the comma (,) after "oxide"

Column 4, line 47 :

$$-C_2H_4OC_2H_4-OC_2H_4OH,$$

should be

-- $-C_2H_4OC_2H_4-OC_2H_4OH$; --

Column 5, line 48 : add --of-- after "monoethers"

PO-1050
(5/69)

UNITED STATES PATENT OFFICE
CERTIFICATE OF CORRECTION

Patent No. 3,954,573 Dated May 4, 1976

Inventor(s) Karl Gustav Lennart Dahlgren

It is certified that error appears in the above-identified patent and that said Letters Patent are hereby corrected as shown below:

Column 6, line 43 : "$m_3 3$" should be -- $m_3$--

Column 6, line 60 :

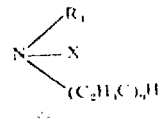

should be

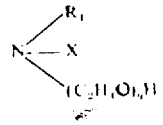

Column 11, Table II, under column Control, 5th line : "161" should be -- $16^{\frac{1}{}}$ --

Column 11, line 63 : delete "range from about phenol, from about grams of"

Column 12, line 11 : "rage" should be -- range --

Column 13, line 42 : "An electroplating composition" should be -- An acidic aqueous bath --

UNITED STATES PATENT OFFICE
CERTIFICATE OF CORRECTION

Patent No. 3,954,573 Dated May 4, 1976

Inventor(s) Karl Gustav Lennart Dahlgren

It is certified that error appears in the above-identified patent and that said Letters Patent are hereby corrected as shown below:

Column 15, line 10 :

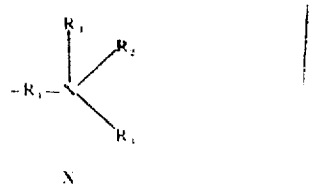

should be

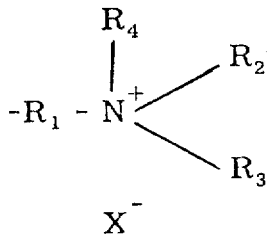

Signed and Sealed this

Twenty-first Day of September 1976

[SEAL]

*Attest:*

RUTH C. MASON
*Attesting Officer*

C. MARSHALL DANN
*Commissioner of Patents and Trademarks*